United States Patent [19]

Svensson, deceased et al.

[11] 4,320,877

[45] Mar. 23, 1982

[54] COIL TYING MACHINE

[75] Inventors: Karl-Erik Svensson, deceased, late of Hagersten, Sweden; by Henny A. V. Svensson, heiress, Hagersten; by Karl J. Svensson, heir, Alvsjo; Hans T. Svensson, heir, Hagersten, all of Sweden

[73] Assignee: Telefonaktiebolaget L M Ericsson, Stockholm, Sweden

[21] Appl. No.: 25,947

[22] Filed: May 23, 1979

[30] Foreign Application Priority Data

Apr. 3, 1978 [SE] Sweden ..... 7803693

[51] Int. Cl.[3] ..... B21C 47/00; B21C 47/02

[52] U.S. Cl. ..... 242/81; 242/78.1

[58] Field of Search ..... 242/81, 82, 78.1, 78.3, 242/78.8, 84, 158 B

[56] References Cited

U.S. PATENT DOCUMENTS 2,985,401 5/1961 Gazet ..... 242/81
3,273,819 9/1966 Sivilotti ..... 242/78.1
3,981,458 9/1976 Rogers ..... 242/158 B
4,075,747 2/1978 Hague ..... 242/78.3

*Primary Examiner*—Edward J. McCarthy
*Attorney, Agent, or Firm*—Hane, Roberts, Spiecens & Cohen

[57] ABSTRACT

A device for winding coils of a cable, wire etc. is provided with a gabled rotating capstan having a sliding core that alternately holds a cable end or gives free way for the ready-wound coil. A cable laying device is provided with a cable guide and a laying wheel and arranged for laying the cable in even layers between the gables. The winding device is further provided having a cable driving wheel with a ratchet on a rotatable driving arm and an air driven piston for rotating the driving arm and also with a rotatable inserting arm with the mentioned cable guide, where the feeding arm is arranged to push the inserting arm so as to place the cable guide in a position where the cable can be held between the sliding core and one of the gables of the winding coil.

1 Claim, 7 Drawing Figures

COIL TYING MACHINE

FIELD OF THE INVENTION

The present invention refers to an arrangement for winding cable, wire, thread and the like in coils according to the introduction to the claim below.

Description of Prior Art

A cable coiling or winding arrangement provided with one single capstan for coiling, a cable guide and a cable laying wheel is known from the Swedish patent No. 7607070-5 (391.703). In the known arrangement almost every movement during the laying of the cable is controlled by a special air driven piston. The great number of pistons has caused difficulties in the coordination between their movements which has been demonstrated by the fact that parts of the cable guide arrangement sometimes have collided so that piston rods have been bent and destroyed.

SUMMARY OF THE INVENTION

In the coiler according to the invention the cable layer proper is controlled by one single air driven piston which can develop a considerable force. The characteristics of the invention appear from the claim below.

With the new arrangement according to the invention a safer and smoother cooperation than earlier is obtained between the parts included in the cable layer proper.

BRIEF DESCRIPTION OF THE DRAWINGS

There is hereafter described a coil winding arrangement according to the invention making reference to the accompanying drawing which shows in FIGS. 1 and 2 a side view of the complete machine in different positions, in FIG. 3 a cable guide, in FIGS. 4 and 5 a cable layer arrangement and a reel in different positions, in FIG. 6 a picture in detail of an arrangement for transportation of the cable layer, and in FIG. 7 a cable cutter.

PREFERRED EMBODIMENT

Figure 1:
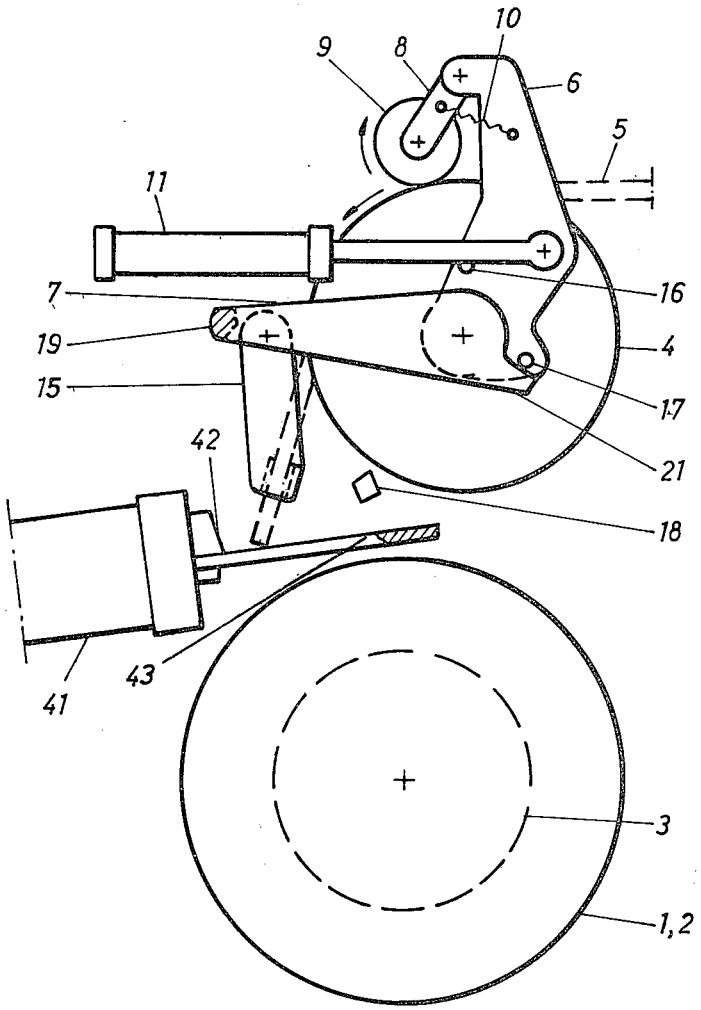
Figure 2:
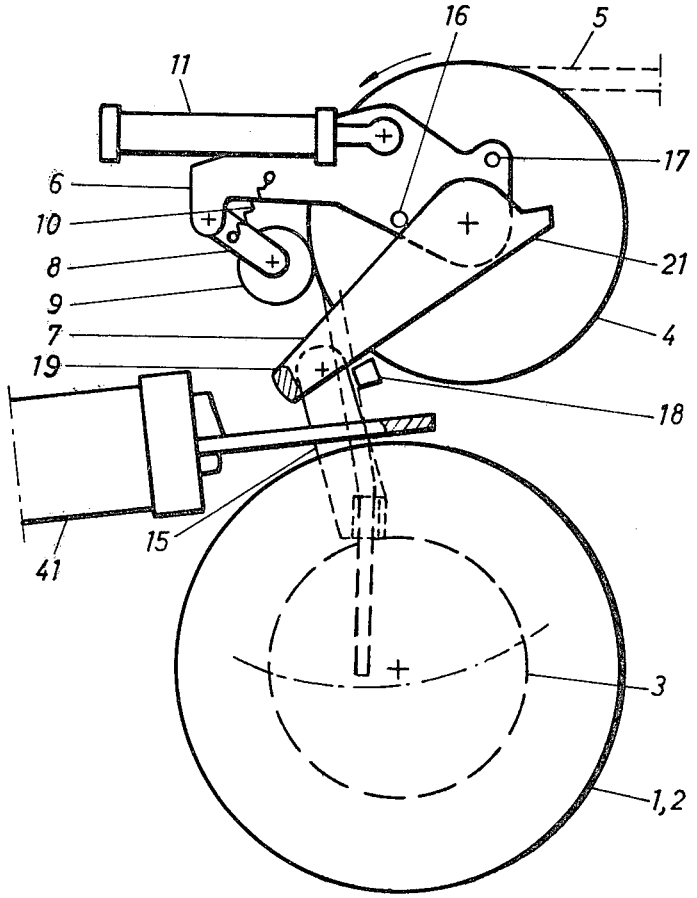

The preferred embodiment of the coil winding machine shows, as appears from FIGS. 1 and 2 a rotatable capstan having two sidewalls 1 and 2 and a central hub or core 3. Furthermore a cable layer wheel 4 is included, provided with a V-track for the cable 5. Around the axis of the layer wheel two arms are arranged to be rotated, a driving arm 6 and an inserting arm 7. The driving arm 6 carries on a turnable rocker 8 a driving wheel 9 provided with a ratchet. The driving wheel is pressed by a tension spring 10 against the periphery of the layer wheel 4 and against the cable in the V-track of the layer wheel. An air driven piston 11 has its piston rod connected to the driving arm 6 and is arranged to rotate it from a vertical position in FIG. 1 to a horizontal position in FIG. 2 and raise it again. The inserting arm 7 is provided with a cable guide 15 which is rotatably attached on its outer part.

Furthermore the driving arm 6 is provided with two lips 16 and 17. One of the lips 16 is intended to press the inserting arm 7 downwards towards the capstan during the lowering of the driving arm. The movement downwards of the inserting arm is then limited by a stop 18 being firmly united with the frame of the arrangement.

When the inserting arm 7 takes its lower end position the position of the cable guide 15 is determined by the mentioned stop 18 and by a second stop 19 being firmly united with the inserting arm 7.

The second lip 17 is arranged at the raising of the driving arm 6 to lift the inserting arm 7 to its upper position by pressing a projective part 21 of the inserting arm.

Figure 3:
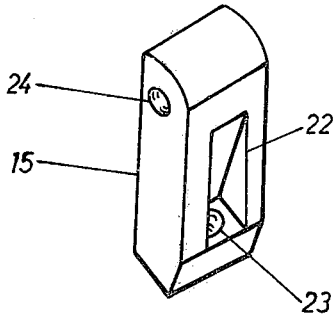
Figure 4:
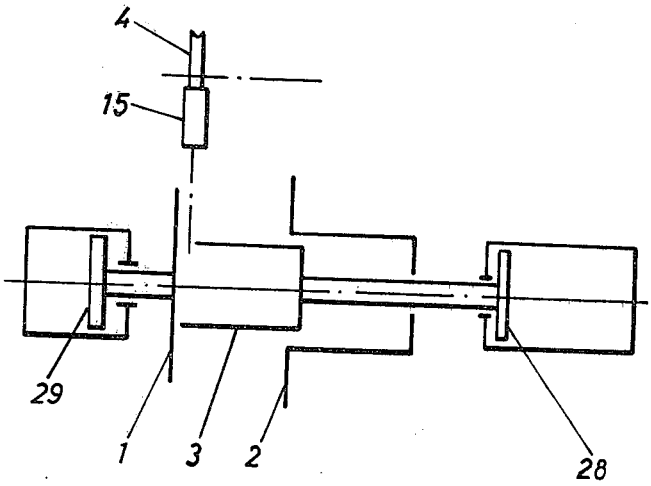
Figure 5:
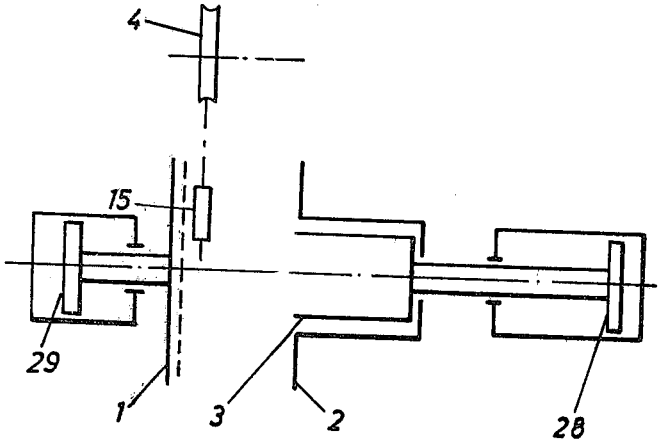

The cable guide 15, as appears from the perspective view of FIG. 3, is designed as an oblong parallelepiped. On one of its sides a groove 22 for the cable is cut and in its wall a hole 23 for the cable is arranged. A hole 24 passes through the cable guide, in the end opposite the hole 23 for a bolt which also passes through the cable conductor and the inserting arm 7. The cable guide 15 is rotatable about this bolt, the hub or core 3 of the capstan, as appears from a comparison between FIGS. 4 and 5, is movable along the axis of the capstan when influenced by an air drive piston 28. At the same time as the core 3 is pulled out from the capstan in a manner which appears from FIG. 5, one of the capstan sidewalls is moved by a second air driven piston 29 to a position in which the space between the end walls 1 and 2 is wider when the core 3 is pulled out than when it is placed between them. The core 3 is arranged in such a way that it has its diameter somewhat reduced at the beginning of the pulling out movement.

Figure 6:
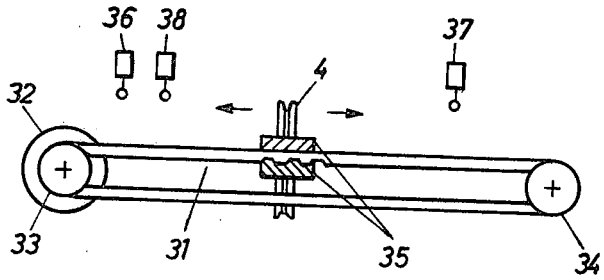

The cable layer wheel 4 together with its associated details the driving arm 6, the inserting arm 7, the driving piston 11, the cable guide 15 etc. is arranged to be moved backwards and forwards between the walls 1 and 2 of the capstan when winding the cable coil in order to have the cable wound in even layers. For moving the arrangement, as appears from FIG. 6, a so called cog belt 31 having cogs on its inside is arranged between a wheel 33 driven by an electrical motor 32 and a counter wheel 34. The motor 32 of a type with low inertia is arranged to drive the belt in alternating directions and thus the laying arrangement which is attached to the cog belt 31 by means of two jaws 35. Two limit switches 36 and 37 are arranged to indicate to the control system of the tying machine, which is considered unnecessary to describe further, that the cable lying arrangement has reached an end position so that the driving direction of the motor 32 is to be changed.

A third limit switch 38 is arranged as a support at the guiding of the layer arrangement to a position where the end of the cable is to be held by the core 3 of the capstan; then the layer arrangement, as appears from FIG. 5, shall take a position somewhat inside the outer capstan gable 1.

Figure 7:
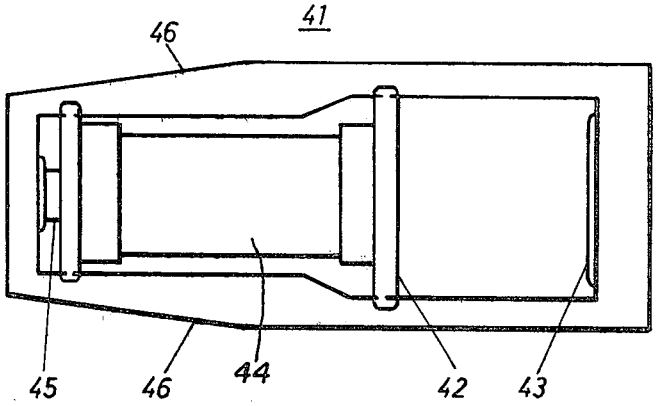

A cable cutter 41 is associated with the coil tying machine, FIGS. 1, 2 and 7. During the coiling the cable shall pass between a stationary blade 42 and a movable blade 43 of the cable cutter 41. The cable cutter is controlled by an air driven piston 44. The piston is arranged to push a piston rod 45 when cutting so that this in its turn will pull the movable blade 43 by means of a frame construction 46 towards the stationary blade 42 and thus cut the cable.

The function of the coil winding machine for repeated coiling of cable and delivering of these coils is suitably described starting from the winding of a coil going on. The parts of the arrangement then take the positions shown in FIG. 1 with the driving arm 6 raised in a vertical position and the inserting arm 7 and the cable guide 15 in their upper positions; the end of the cable 5 is then held between the end of the core 3 and the outer capstan gable 1 in a way which appears from FIG. 4. When a measuring wheel, not shown in the drawing, and electronic circuits cooperating with this indicate that 15 meters of cable remain to be wound, the cutting of the cable is prepared for by reducing the speed of the cable at the coiling from the highest speed, which can be up to 400 meters per minute, to stand still when the intended length of the cable has been coiled. When the rotation of the capstan has ceased the cable is cut by pulling the movable blade 43 of the cable cutter 41 towards the stationary blade 42. After that the core 3 of the capstan is pulled out and during the last part of the pulling out movement of the core the space between the gables 1 and 2 is widened, which appears from FIG. 5, permitting the coil of cable to fall vertically from the machine. After the cutting the cable cutter immediately reverts to its open position.

The winding of a new cable coil is begun by tilting the driving arm 6 to a horizontal position due to pulling from the driving piston 11. The driving wheel 9, which after the cutting has held the cable 5 and prevented it from being pulled away from the coil tying machine, now pushes the cable forward so that its end approximately reaches the centre of the core 3, see FIG. 2. The lip 16 of the driving arm 6 is situated in order to press the inserting arm 7 and thus the cable guide 15 downwards through the opening of the cable cutter to guide the end of the cable to its right position. The position of the cable guide 15 in this phase is determined by the two stops 18 and 19. The core 3 of the capstan is now set in motion to press against the opposite capstan gable 1 and will then hold the cable end. The other capstan gable 2 takes a position for coiling in a way which appears from FIG. 4. By action of the driving piston 11 the driving arm 6 will resume its vertical position. The lip 17 of the driving arm is situated in order to press against the projective part 21 of the inserting arm 7 and to lift it together with the cable guide 15 to their upper position. The parts of the coil tying machine now take the positions appearing from FIG. 1. The coiling of cable can start again and be carried out in the manner which already has been described.

We claim:

1. In a coil winding machine for winding a cablelike elongated member, the machine having a single rotatable capstan with a core and two sidewalls, means for moving the core along the axis of rotation of the capstan so that an end of the elongated member can be controllably pinched between the core and one sidewall when the core is in one position and so that when the core is in another position there is sufficient clearance for removal of a formed coil, the machine also having a grooved cable layering wheel oscillatingly movable in a direction parallel to the direction of the axis of rotation of the capstan whereby a coil of even layers of the elongated member can be built on the core, the improvement comprising a driving arm rotatable about the axis of the cable layering wheel, a driving wheel, means for connecting said driving wheel to the free end of said driving arm in abutting relationship with the periphery of the cable layering wheel whereby the elongated member is pressed therebetween, driving means for oscillatingly driving said driving arm between a first position whereby a portion of the elongated member is urged toward the core through the rolling action of said driving wheel and a second position whereby said portion of the elongated member is retracted, an inserting arm rotatable about the axis of the cable layering wheel, a cable guide rotatably connected to the free end of said inserting arm, and means on said driving arm for engaging said inserting arm to reciprocatingly drive the latter so when said driving arm is in said first position said guide means positions the end of the elongated member in position to be pinched between the core and the one sidewall.

* * * * *